US007249930B2

(12) United States Patent
Lombard et al.

(10) Patent No.: US 7,249,930 B2
(45) Date of Patent: Jul. 31, 2007

(54) VARIABLE-NOZZLE TURBOCHARGER WITH INTEGRATED BYPASS

(75) Inventors: Alain R. Lombard, Uxegney (FR); Sebastien Ferrari, Thaon les Voges (FR); Jean Luc Perrin, Girmont (FR); Patrick Masson, Urimenil (FR)

(73) Assignee: Honeywell International, Inc., Morristown, NJ (US)

( * ) Notice: Subject to any disclaimer, the term of this patent is extended or adjusted under 35 U.S.C. 154(b) by 65 days.

(21) Appl. No.: 11/289,217

(22) Filed: Nov. 29, 2005

(65) Prior Publication Data

US 2007/0122267 A1 May 31, 2007

(51) Int. Cl.
*F03B 3/18* (2006.01)

(52) U.S. Cl. ..... 415/145; 415/156; 415/157; 60/602

(58) Field of Classification Search ..... 415/145, 415/151, 156, 157, 167; 60/602
See application file for complete search history.

(56) References Cited

U.S. PATENT DOCUMENTS 4,445,815 A 5/1984 Fortmann
4,499,731 A * 2/1985 Moser ..... 60/602
5,855,117 A * 1/1999 Sumser et al. ..... 60/602
2006/0037317 A1* 2/2006 Leavesley ..... 60/602

FOREIGN PATENT DOCUMENTS

WO WO2004048755 6/2004
WO WO2006102912 10/2006

OTHER PUBLICATIONS

PCTISR, Mar. 16, 2007, Honeywell.

* cited by examiner

*Primary Examiner*—Ninh H. Nguyen
(74) *Attorney, Agent, or Firm*—Chris James; Faisal Adnan

(57) ABSTRACT

A turbine housing assembly includes a tubular piston disposed in a bore of a turbine housing and axially slidable between a closed position and an open position for blocking a nozzle by an amount dependent on axial positioning of the piston. A bypass control member is disposed in the turbine housing and is slidable between a no-bypass position closing a bypass passage and a open bypass opening the bypass passage. The piston is structured and arranged to slide relative to the bypass control member for a part of a full stroke of the piston from the closed position toward the open position thereof, and then to engage the bypass control member and cause the bypass control member to slide together with the piston as the piston further slides toward the open position thereof such that the bypass control member is moved toward the bypass position.

10 Claims, 5 Drawing Sheets

VARIABLE-NOZZLE TURBOCHARGER WITH INTEGRATED BYPASS

BACKGROUND OF THE INVENTION

The present invention relates generally to exhaust gas-driven turbochargers, and relates more particularly to exhaust gas-driven turbochargers having a variable turbine nozzle of the axially sliding piston type for varying the size of the nozzle that leads into the turbine wheel so as to regulate flow into the turbine wheel.

Regulation of the exhaust gas flow through the turbine of an exhaust gas-driven turbocharger provides known operational advantages in terms of improved ability to control the amount of boost delivered by the turbocharger to the associated internal combustion engine. The regulation of exhaust gas flow is accomplished by incorporating variable geometry into the nozzle that leads into the turbine wheel. By varying the size of the nozzle flow area, the flow into the turbine wheel can be regulated, thereby regulating the overall boost provided by the turbocharger's compressor.

Variable-geometry nozzles for turbochargers generally fall into two main categories: variable-vane nozzles, and sliding-piston nozzles. Vanes are often included in the turbine nozzle for directing the exhaust gas into the turbine in an advantageous direction. Typically a row of circumferentially spaced vanes extend axially across the nozzle. Exhaust gas from a chamber surrounding the turbine wheel flows generally radially inwardly through passages between the vanes, and the vanes turn the flow to direct the flow in a desired direction into the turbine wheel. In a variable-vane nozzle, the vanes are rotatable about their axes to vary the angle at which the vanes are set, thereby varying the flow area of the passages between the vanes.

In the sliding-piston type of nozzle, the nozzle may also include vanes, but the vanes are fixed in position. Variation of the nozzle flow area is accomplished by an axially sliding piston that slides in a bore in the turbine housing. The piston is tubular and is located just radially inwardly of the nozzle. Axial movement of the piston is effective to vary the axial extent of the nozzle leading into the turbine wheel, thus varying the "throat area" at the turbine wheel inlet. When vanes are included in the nozzle, the piston can slide adjacent to radially inner (i.e., trailing) edges of the vanes; alternatively, the piston and vanes can overlap in the radial direction and the piston can include slots for receiving at least a portion of the vanes as the piston is slid axially to adjust the nozzle.

There are times during the operation of a turbocharger when it is desired to pass as much flow through the turbine housing as possible. For example, it may be desirable to minimize the backpressure felt by the engine during certain operating conditions, and this is accomplished by reducing the flow restriction downstream of the engine as much as possible. In a sliding piston-type variable turbine nozzle, the downstream flow restriction is reduced by fully opening the piston to maximize the throat area at the turbine wheel inlet. However, in some cases, even fully opening the piston may not allow as much flow to pass as may be desired.

BRIEF SUMMARY OF THE INVENTION

The present invention addresses the above needs and achieves other advantages, by providing a turbine housing assembly for a variable-nozzle turbocharger, in which an integrated bypass feature is arranged in the turbine housing assembly for allowing a proportion of exhaust gas to pass from the turbine housing chamber through a bypass passage without passing through the turbine wheel or the bore in the turbine housing. In one embodiment of the invention, the turbine housing assembly includes a tubular piston disposed in the bore of the turbine housing and axially slidable between a closed position and an open position for blocking the nozzle by an amount dependent on axial positioning of the piston so as to regulate flow into the turbine wheel. A bypass control member is disposed in the turbine housing and is slidable between a no-bypass position closing the bypass passage and a bypass position opening the bypass passage. The bypass member preferably is biased by a biasing device toward the no-bypass position. The piston is structured and arranged to slide relative to the bypass control member for a part of a full stroke of the piston from the closed position toward the open position thereof, and then to engage the bypass control member and cause the bypass control member to slide together with the piston as the piston further slides toward the open position thereof such that the bypass control member is moved toward the bypass position.

The bypass control member in one embodiment is generally ring-shaped or annular and concentrically surrounds the piston, and the piston includes a radially outwardly extending portion that is spaced from the bypass control member when the piston is in the closed position and that engages the bypass control member when the piston is slid toward the open position to cause the bypass control member to slide with the piston. The radially outwardly extending portion of the piston can comprise a flange extending from an upstream end of the piston.

The turbine housing in one embodiment defines a guide space adjacent the bypass passage and the bypass control member includes a cylindrical portion that slides within the guide space. The bypass control member includes a flange portion extending radially inwardly from the cylindrical portion and positioned to be engaged by the radially outwardly extending portion of the piston. A compression spring can be disposed between the flange portion of the bypass control device and a portion of the turbine housing for biasing the bypass control member toward the no-bypass position.

Actuation of the piston can be accomplished in various ways, such as by mechanical linkage connected with the piston and operated by a suitable actuator. Alternatively, in one embodiment of the invention, the piston includes a cylindrical portion and the turbine housing defines an annular space that receives the cylindrical portion of the piston for guiding the piston's axial sliding movement. Seals for sealing the piston are disposed between radially outer and radially inner surfaces of the cylindrical portion of the piston and corresponding opposing surfaces of the annular space. The turbine housing defines a fluid passage extending through the turbine housing and connected with the annular space for communicating fluid to the annular space such that a fluid pressure differential applied through the fluid passage to the annular space causes a force to be exerted on the piston to move the piston axially relative to the turbine housing. A compression spring can be arranged in the turbine housing for biasing the piston in opposition to the fluid pressure differential.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
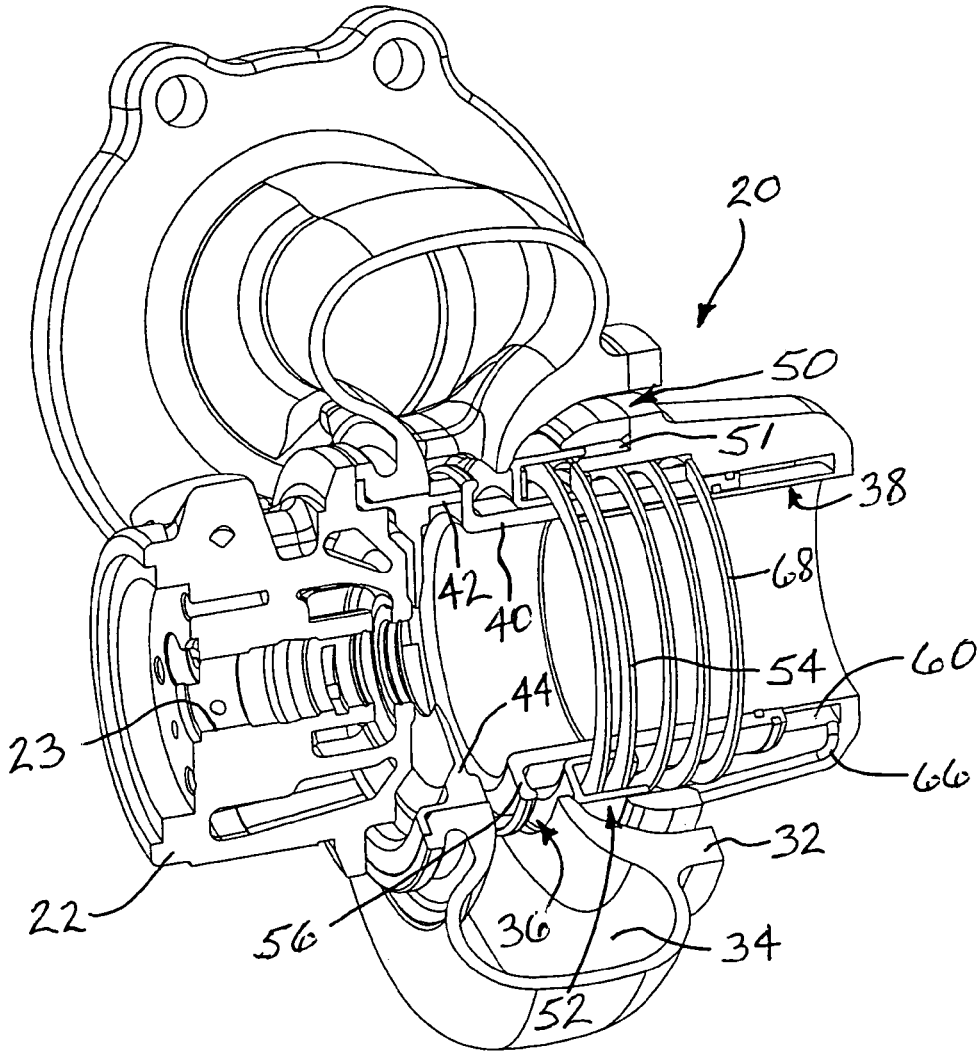
FIG. 1 is an isometric view, partially cut away to show internal details, of a turbine housing assembly for a turbocharger, in accordance with one embodiment of the invention.

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1 through 4 and 4A depict a turbine housing assembly 20 for a turbocharger in accordance with one embodiment of the invention. The turbine housing assembly is shown mounted to one side of a center housing 22 of the turbocharger. The center housing defines a bore 23 that houses bearings (not shown) for a rotatable shaft (not shown) of the turbocharger. A compressor wheel (not shown) is mounted on one end of the shaft and is housed in a compressor housing (not shown) that is attached to the opposite side of the center housing 22. A turbine wheel (not shown) is mounted on the other end of the shaft and is housed in a turbine housing 32 of the turbine housing assembly. The turbine housing defines a generally annular chamber 34 that surrounds the turbine wheel and receives engine exhaust gas for driving the turbine wheel. The exhaust gas flows generally radially inwardly from the chamber 34 through a nozzle 36 defined by the turbine housing and other components (as further described below) and flows through the turbine wheel, which turns the flow toward an axial direction.

The turbine housing 32 defines an axial bore 38 in which the turbine wheel resides at an upstream end of the bore. The exhaust gas that has flowed through the wheel is discharged through a downstream end of the bore 38.

Figure 2:
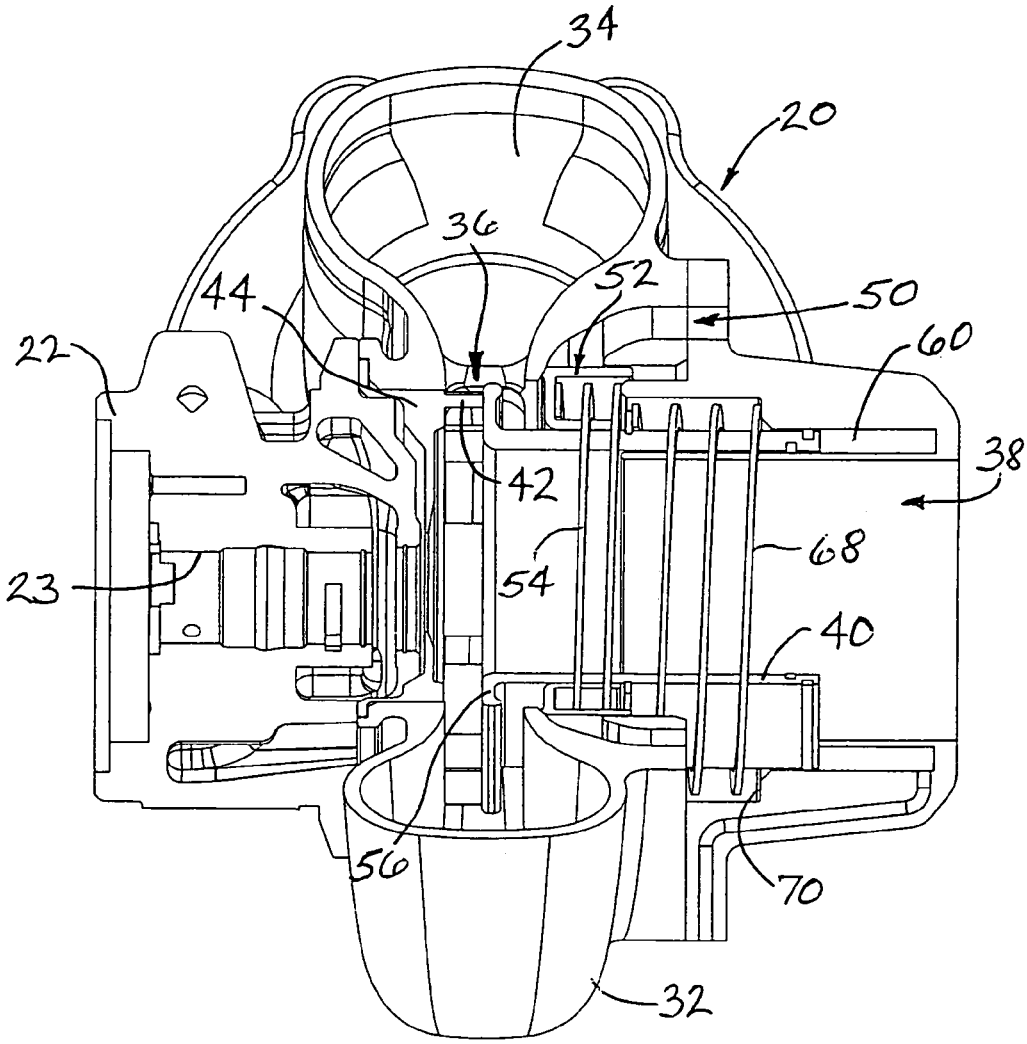
FIG. 2 is sectioned isometric view of the turbine housing assembly, showing the piston in a closed position.

A piston 40 is mounted in the bore 38 of the turbine housing such that the piston is axially slidable relative to the turbine housing. The piston is tubular in configuration. The piston is disposed between the nozzle 36 and the turbine wheel, and is movable to various axial positions for regulating the size of the nozzle flow area through which exhaust gas can flow from the chamber 34 to the turbine wheel. The piston 40 is received within the bore 38 and is slidable relative to the turbine housing. An array of circumferentially spaced vanes 42 is mounted on a heat shield 44 mounted between the turbine housing 32 and center housing 22 proximate the turbine wheel. The vanes 42 are positioned to extend partway across the axial extent of the nozzle 36. In a closed position of the piston 40, an upstream end of the piston is abutting or closely proximate to the vanes 42 as shown in FIGS. 1 and 2, and accordingly the exhaust gas that flows through the nozzle is constrained to flow through the spaces between the vanes 42. In an open position of the piston, the upstream end of the piston is spaced from the vanes 42 as in FIGS. 3 and 4, in which case some of the exhaust gas flows through the vanes 42 and an additional amount of exhaust gas flows through an opening defined between the ends of the vanes 42 and the end of the piston. The closed position of the piston thus provides a relatively greater amount of flow restriction than does the open position. Adjustment of the piston position can be used for regulating the flow into the turbine wheel, thereby regulating the overall boost provided by the turbocharger to an internal combustion engine to which the turbocharger is coupled.

Figure 3:
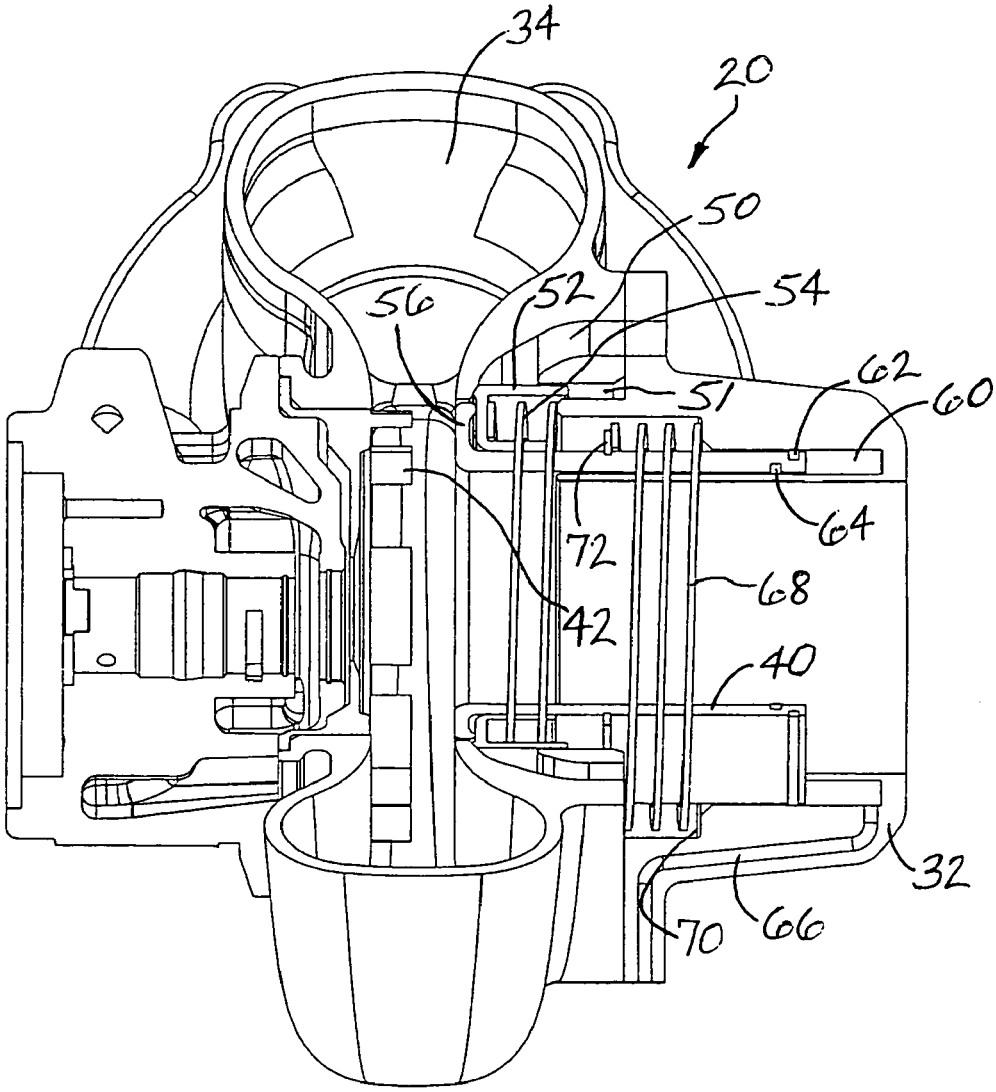
FIG. 3 is a view similar to FIG. 2, showing the piston in a partially open position.
Figure 4:
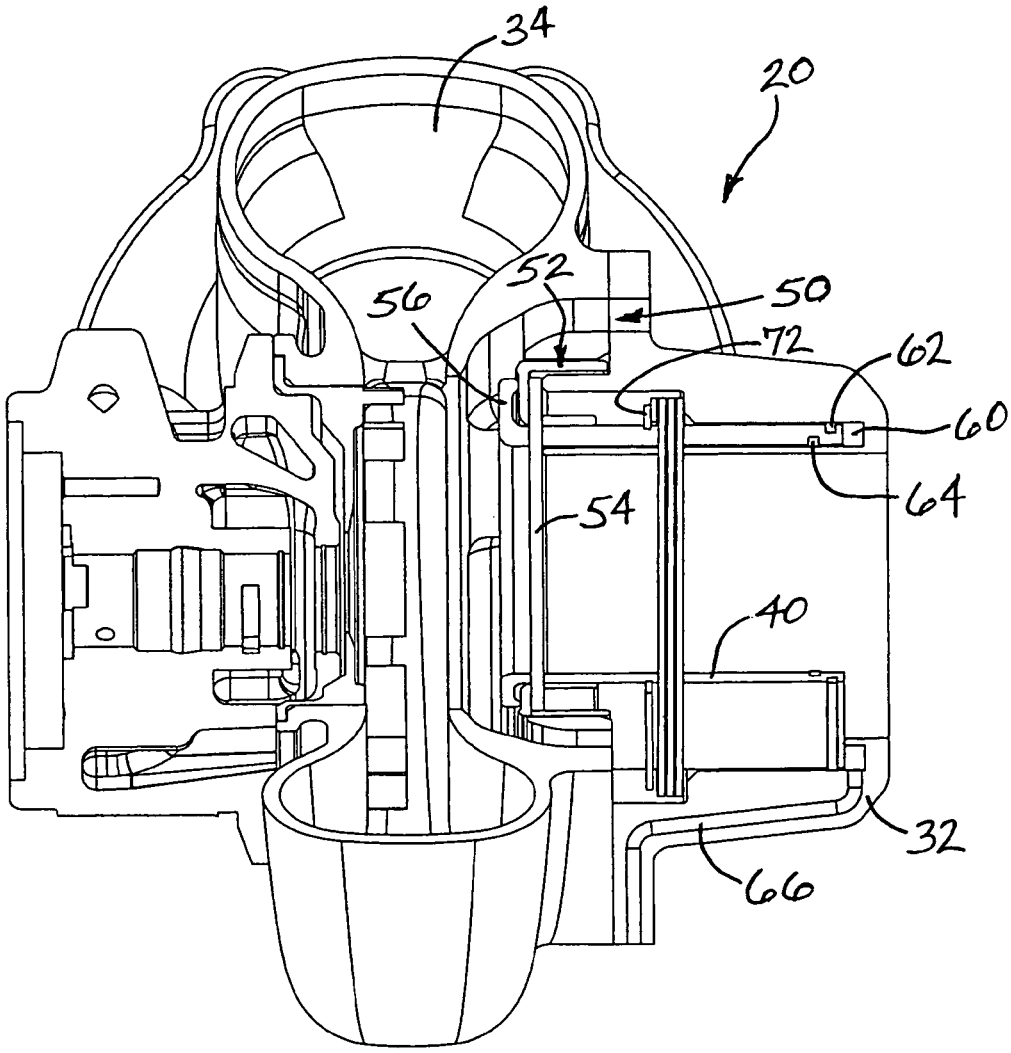
FIG. 4 is a view similar to FIG. 2, showing the piston in a fully open position.
Figure 4A:
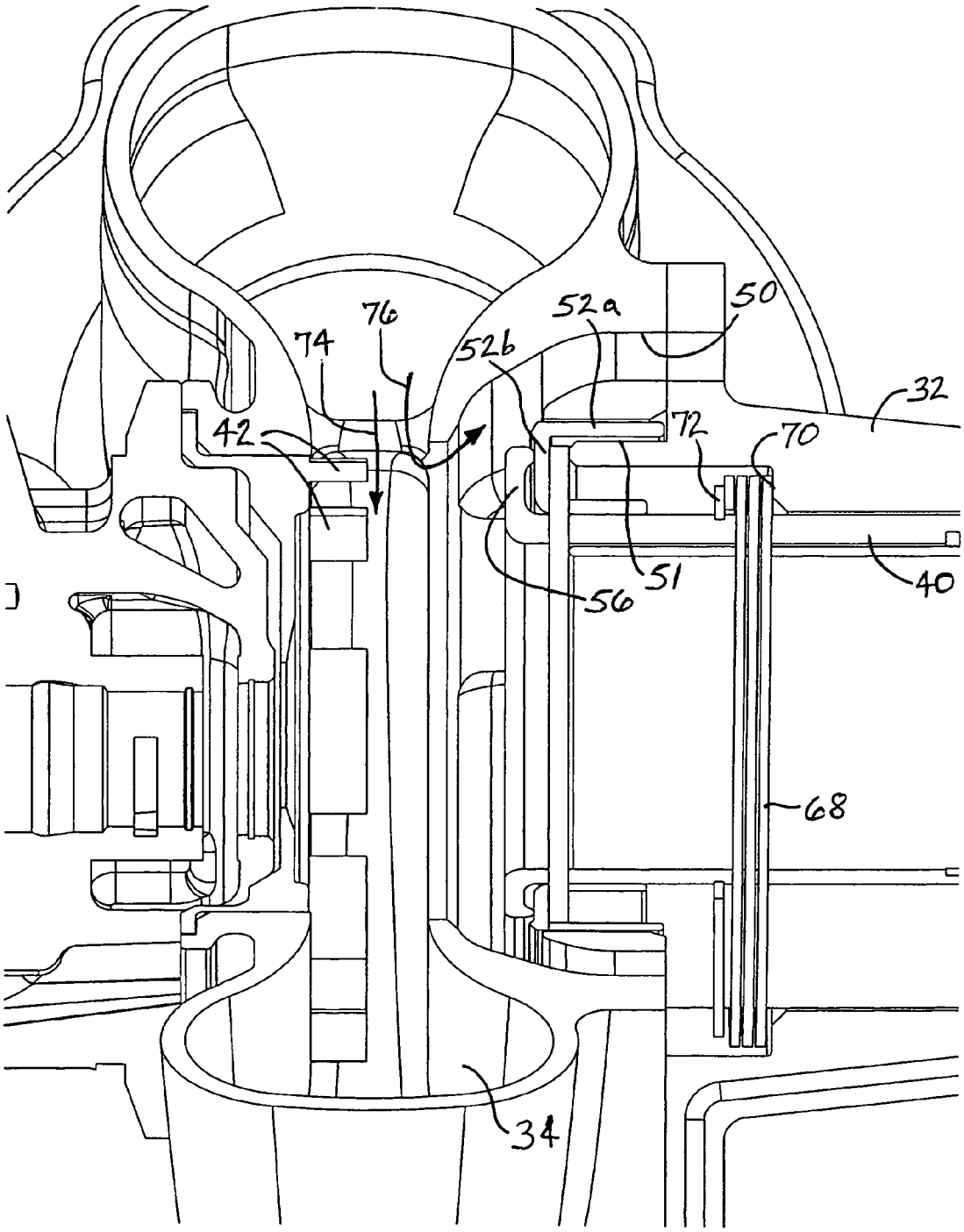
FIG. 4A is a magnified view of a portion of FIG. 4.

The turbine housing assembly 20 includes an integrated bypass for allowing some exhaust gas to bypass the turbine wheel and turbine housing bore 38. More particularly, the turbine housing defines a bypass passage 50 for allowing a portion of exhaust gas to flow from the chamber 34 through the bypass passage 50 without passing through the turbine wheel or turbine housing bore. A bypass control member 52 is disposed in the turbine housing and is slidable between a no-bypass position closing the bypass passage (FIGS. 1-3) and a bypass position opening the bypass passage (FIGS. 4 and 4A). The bypass control member 52 is generally ring-shaped or annular in configuration and concentrically surrounds the piston 40. A compression spring 54 is compressed between the turbine housing and the bypass control member and urges the bypass control member toward its no-bypass position. The turbine housing defines a guide space 51 adjacent the bypass passage 50, and the bypass control member includes a cylindrical portion 52*a* (FIG. 4A) that slides within the guide space. The engagement of the cylindrical portion 52*a* in the guide space 51 also serves to discourage exhaust gas from flowing around the bypass control member into the turbine housing bore 38, by creating a circuitous pathway between the bypass control member and turbine housing.

The piston 40 has a radially outwardly projecting flange 56 at its upstream end. The flange 56 is arranged to abut the bypass control member 52 when the piston 40 has moved to a partially open position, as depicted in FIG. 3. The bypass control member includes a flange portion 52*b* extending radially inwardly from the cylindrical portion 52*a* and positioned to be engaged by the flange 56 of the piston.

The piston 40 is able to move even farther in the downstream direction. With further movement of the piston 40 toward its fully open position, the bypass control member 52 begins to move along with the piston 40 such that the bypass passage 50 begins to be opened. FIGS. 4 and 4A show the bypass control member in a fully open position.

The piston can be actuated in various ways. For example, a mechanical linkage (not shown) can be connected with the piston and operated by a suitable actuator (not shown). Alternatively, in one embodiment of the invention as illustrated, the actuation of the piston 40 in the opening direction is accomplished using fluid pressure differential that acts on the piston. More specifically, the piston 40 is axially slidable within an annular cavity or guide space 60 defined by the turbine housing. The piston is sealed within the guide space 60 by a sealing arrangement. In one embodiment, the sealing arrangement can comprise an outer seal 62 arranged between a radially outer surface of the piston and a radially outer wall of the guide space 60, and an inner seal 64 arranged between a radially inner surface of the piston and a radially inner wall of the guide space 60. A fluid passage 66 is defined in the turbine housing and connects with the portion of the guide space 60 sealed by the seals 62, 64. Exertion of a differential fluid pressure through the passage 66 causes fluid pressure to act on the piston 40 for axially moving the piston. In the illustrated embodiment, exertion of a vacuum through the passage 66 moves the piston toward the open position.

A compression spring 68 is arranged to exert a force on the piston 40 tending to move the position to its closed position. The spring 68 is compressed between an upstream-facing surface 70 of the turbine housing 32 and a radially outward projection 72 on the piston. The projection 72 can comprise a snap ring mounted in a groove in the outer surface of the piston. The spring 68 thus acts on the piston in an opposite direction to that of the fluid pressure when vacuum is exerted on the space 60. When enough vacuum is exerted to overcome the spring force on the piston, the piston moves toward the open position. Various partially open piston positions can be achieved by suitably regulating the degree of vacuum exerted on the space 60 so that the spring force and fluid force balance each other at different points along the full piston stroke.

It is also possible to configure the turbine housing and piston so that a fluid pressure differential causes the piston to close, while a compression spring urges the piston toward the open position.

In operation, at low engine speeds and low throttle settings the piston 40 typically is in its closed position as in FIGS. 1 and 2, since exhaust gas flow rates are low at such conditions. At other operating conditions demanding greater exhaust gas flow rates (e.g., rapid acceleration, high engine speeds, etc.), the piston 40 can be moved to a partially open position such as in FIG. 3 to allow greater gas flow rate into the turbine wheel. The bypass control member 52 may still be in a closed or no-bypass position, as shown. At extreme operating conditions where the maximum possible exhaust gas flow rate is desired, the piston is moved to the fully open position as in FIGS. 4 and 4A so that the bypass control member 52 is moved to an open or bypass position. In this condition, some exhaust gas flows from the chamber 34 through the nozzle 36 into the turbine housing bore as illustrated by the arrow 74 in FIG. 4A, while an additional amount of exhaust gas flows from the chamber through the bypass passage 50 as illustrated by the arrow 76, thereby bypassing the turbine housing bore.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbine housing assembly for a turbocharger having a variable-nozzle turbine, comprising:

a turbine housing defining a bore extending therethrough in an axial direction, the turbine housing defining a chamber surrounding the bore for receiving exhaust gas to be directed into the bore, the turbine housing further defining a nozzle leading from the chamber into the bore;

a tubular piston disposed in the bore of the turbine housing and axially slidable relative to the turbine housing, the piston being slidable between a closed position and an open position for blocking the nozzle by an amount dependent on axial positioning of the piston so as to regulate flow into the bore;

a bypass passage defined in the turbine housing for allowing a portion of exhaust gas to flow from the chamber through the bypass passage without passing through the turbine housing bore; and a bypass control member disposed in the turbine housing and slidable between a no-bypass position closing the bypass passage and a bypass position opening the bypass passage, wherein the piston and bypass control member are structured and arranged such that the piston slides while the bypass control member remains stationary for a part of a full stroke of the piston from the closed position toward the open position thereof, and then the piston engages the bypass control member and causes the bypass control member to slide together with the piston as the piston further slides toward the open position thereof such that the bypass control member is moved toward the bypass position.

2. The turbine housing assembly of claim 1, wherein the bypass control member is generally annular and concentrically surrounds the piston, and the piston includes a radially outwardly extending portion that is spaced from the bypass control member when the piston is in the closed position and that engages the bypass control member when the piston is slid toward the open position.

3. The turbine housing assembly of claim 2, wherein the radially outwardly extending portion comprises a flange extending from an upstream end of the piston.

4. The turbine housing assembly of claim 2, wherein the turbine housing defines a guide space adjacent the bypass passage and the bypass control member includes a cylindrical portion that slides within the guide space.

5. The turbine housing assembly of claim 4, wherein the bypass control member includes a flange portion extending radially inwardly from the cylindrical portion and positioned to be engaged by the radially outwardly extending portion of the piston.

6. The turbine housing assembly of claim 1, further comprising a compression spring disposed between the bypass control member and a portion of the turbine housing for biasing the bypass control member toward the no-bypass position.

7. The turbine housing assembly of claim 1, wherein the piston includes a cylindrical portion and the turbine housing defines an annular space that receives the cylindrical portion of the piston for guiding the piston's axial sliding movement.

8. The turbine housing assembly of claim 7, further comprising a sealing arrangement for sealing between the piston and opposing surfaces of the annular space.

9. The turbine housing assembly of claim 8, wherein the turbine housing defines a fluid passage extending through the turbine housing and connected with the annular space for communicating fluid to the annular space such that a fluid pressure differential applied through the fluid passage to the annular space causes the piston to move axially relative to the turbine housing.

10. The turbine housing assembly of claim 9, further comprising a compression spring arranged to bias the piston in opposition to the fluid pressure differential.

* * * * *